US010144237B2

(12) United States Patent
Sonnauer et al.

(10) Patent No.: US 10,144,237 B2
(45) Date of Patent: Dec. 4, 2018

(54) APPARATUS AND METHOD FOR CONTROLLING DIRECT PRINTING MACHINES

(71) Applicant: KRONES AG, Neutraubling (DE)

(72) Inventors: Andreas Sonnauer, Woerth (DE); Florian Lauterbach, Illkofen (DE); Peter Lindner, Langquaid (DE)

(73) Assignee: KRONES AG (DE)

( * ) Notice: Subject to any disclaimer, the term of this patent is extended or adjusted under 35 U.S.C. 154(b) by 0 days.

(21) Appl. No.: 15/523,016

(22) PCT Filed: Nov. 5, 2015

(86) PCT No.: PCT/EP2015/075807
§ 371 (c)(1),
(2) Date: Apr. 28, 2017

(87) PCT Pub. No.: WO2016/071444
PCT Pub. Date: May 12, 2016

(65) Prior Publication Data

US 2017/0313112 A1 Nov. 2, 2017

(30) Foreign Application Priority Data

Nov. 6, 2014 (DE) ..... 10 2014 116 201

(51) Int. Cl.
*B41J 2/00* (2006.01)
*B41J 29/393* (2006.01)
*B41J 3/407* (2006.01)

(52) U.S. Cl.
CPC ..... *B41J 29/393* (2013.01); *B41J 3/4073* (2013.01)

(58) Field of Classification Search
None
See application file for complete search history.

(56) References Cited

U.S. PATENT DOCUMENTS 7,001,016 B2 2/2006 Baxter et al.
7,168,803 B2 1/2007 Baxter et al.
(Continued)

FOREIGN PATENT DOCUMENTS

AT 509149 6/2011
CN 1655944 8/2005
(Continued)

OTHER PUBLICATIONS

International Search Report dated Mar. 9, 2016 issued in corresponding International Application No. PCT/EP2015/075807.
(Continued)

*Primary Examiner* — Matthew Luu
*Assistant Examiner* — Tracey McMillion
(74) *Attorney, Agent, or Firm* — Onello & Mello, LLP

(57) ABSTRACT

The invention relates to a method for printing objects, in particular containers, wherein the containers are transported along a specified transport path, and the outer surface of the containers is printed at least temporarily by means of at least one printing unit, wherein a controller controls the printing of the containers by means of the at least one printing unit on the basis of at least one printing parameter. According to the invention, at least one object to be printed is printed with at least one test marking in order to ascertain the printing parameter, and the object provided with the test marking is then inspected by means of at least one inspection device, wherein the printing parameter is derived from the result of the inspection.

21 Claims, 2 Drawing Sheets

(56) References Cited

U.S. PATENT DOCUMENTS

Figure 1:
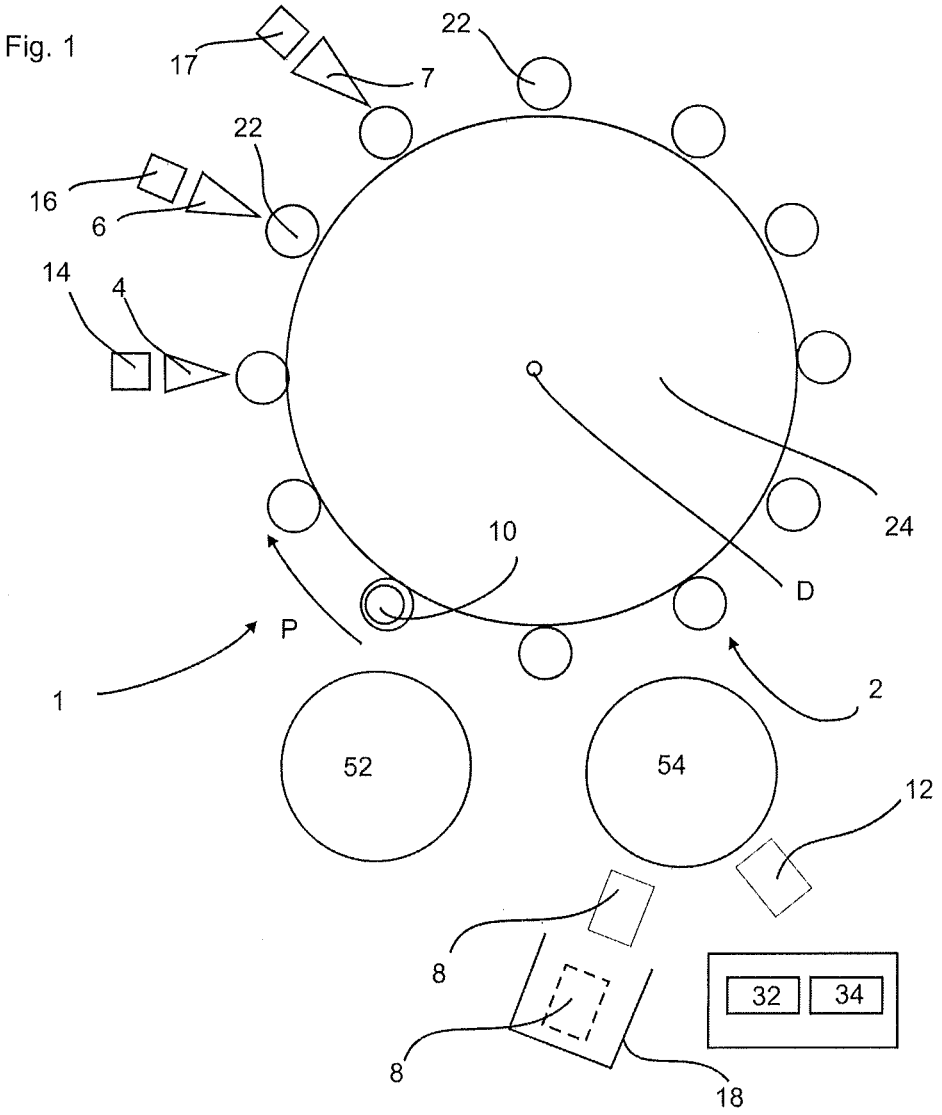

| | | | | |
|---|---|---|---|---|
| 7,766,474 | B2 | 8/2010 | Baxter et al. | |
| 8,070,244 | B2 | 12/2011 | Dumenil | |
| 8,147,026 | B2 * | 4/2012 | Rimai | B41J 3/54 347/19 |
| 8,955,963 | B2 | 2/2015 | Olejniczak et al. | |
| 2002/0134130 | A1 | 9/2002 | Johnson | |
| 2003/0218663 | A1 | 11/2003 | Baxter et al. | |
| 2006/0071993 | A1 | 4/2006 | Baxter et al. | |
| 2007/0019026 | A1 | 1/2007 | Gibson et al. | |
| 2007/0132806 | A1 | 6/2007 | Baxter et al. | |
| 2008/0264276 | A1 | 10/2008 | Dumenil | |
| 2009/0169719 | A1 * | 7/2009 | Orr | B41J 3/4073 427/8 |
| 2012/0050376 | A1 * | 3/2012 | Nagoshi | B41J 2/2142 347/19 |
| 2012/0050392 | A1 | 3/2012 | Puttonen et al. | |
| 2013/0008333 | A1 | 1/2013 | Peter et al. | |
| 2013/0016150 | A1 | 1/2013 | Peter et al. | |
| 2013/0016151 | A1 | 1/2013 | Peter et al. | |
| 2013/0033544 | A1 | 2/2013 | Peter et al. | |
| 2013/0229450 | A1 | 9/2013 | Peter et al. | |
| 2013/0286123 | A1 * | 10/2013 | Olejniczak | B41F 17/001 347/104 |
| 2015/0138295 | A1 | 5/2015 | Lindner et al. | |

FOREIGN PATENT DOCUMENTS

| | | |
|---|---|---|
| DE | 102010008295 | 8/2011 |
| DE | 102012209305 | 12/2013 |
| EP | 1832429 | 9/2007 |
| EP | 1918100 | 5/2008 |
| EP | 2327555 | 6/2011 |
| EP | 2639069 | 9/2013 |
| WO | 2010003933 | 1/2010 |
| WO | 2012140384 | 10/2012 |

OTHER PUBLICATIONS

German Search Report dated Feb. 25, 2015 issued in corresponding German Application No. 10 2014 116 201.3.

Chinese Office Action dated Apr. 2, 2018 issued in corresponding Chinese Application No. 201580059928X with English language translation.

* cited by examiner

APPARATUS AND METHOD FOR CONTROLLING DIRECT PRINTING MACHINES

The present invention relates to an apparatus and a method for printing containers. Apparatus and methods for labelling containers have been known for a long time from the prior art. More recently, however, there has been a changeover to providing containers with direct printing or with multicolour printing. Such apparatus and methods for printing containers are known from the prior art. Thus for example in the as yet unpublished German patent application No. 10 2014 112 484.7 an apparatus and a method for equipping containers is described.

This application deals in particular with the question of how such directly printed containers can be inspected and how it is possible to react to a corresponding inspection of the containers. Thus, according to this application, during production a quality control is employed and the quality of the printing is sporadically controlled visually. Thus, however, no proactive control of the direct printing machine takes place here, but at most a limited control of the colour space by the different colour methods, i.e. additive or subtractive colour methods, and also only the currently operated printing can be monitored.

Therefore the object of the present invention is to provide a method and an apparatus which enable an improved control of the printing and also an improved error correction. These objects are achieved according to the invention by the subjects of the independent claims. Advantageous embodiments and modifications are the subject of the subordinate claims.

In a method according to the invention for printing objects and in particular containers, the objects are transported along a predetermined transport path, and the outer surface of the containers is printed at least temporarily by means of at least one printing unit. In this case a controller controls the printing of the containers by means of the at least one printing unit on the basis of at least one printing parameter and preferably on the basis of a plurality of printing parameters.

According to the invention, in order to ascertain and/or to change this printing parameter at least one object to be printed is printed with at least one test marking (wherein this takes place in particular with the said printing unit), and the object provided with the test marking is then inspected by means of at least one inspection device, wherein the printing parameter is derived and/or ascertained from the result of the inspection. The printing parameter may be any parameter which is characteristic for the print to be applied, such as for instance a relative position of a print head with respect to the container to be printed, a speed of movement of the container with respect to the print head, a reaction of individual printing elements and the like. In addition the parameter may also be a parameter which is characteristic for a colour composition of the print. Advantageously this is a printing parameter from which the readiness to print of the corresponding printing unit may be inferred directly or indirectly or a parameter which is characteristic for the readiness to print of the printing unit. If, for example, the said printing parameter is outside a predetermined tolerance range, this can be evaluated as an indication that the corresponding printing unit is not ready for operation. However, it would also be possible that a plurality of printing parameters is determined and the readiness to print is first confirmed when all these printing parameters meet predetermined conditions (for example are located within specific tolerance windows).

Preferably the control device uses the at least one printing parameter for controlling the printing unit. In this case it is possible that printing parameters which are preferably stored in a storage device can be modified and in particular can also be modified automatically. Preferably, however, such modifications of printing parameters are logged and in particular are also logged with further data such as for instance the time of the modification.

It is therefore proposed to check the prints by means of a test program which preferably requests the user automatically to check the printing unit.

Thus it would be possible for example to run through such a test before the production, but in addition it would also be possible to use specific test cycles, for example hourly or after a specific intake of containers as well as after the production in the event of a recipe change or ink change or also after a manual request.

The said test marking may be the print later which is also to be applied later in the regular working operation. Preferably, however, a special test marking or a special test image is used, which is particularly suitable for evaluation and for correction or for ascertaining the printing parameters. In a first procedure it is possible for a signal which effects an incomplete print to be transmitted to the print controller.

This known test print can be read or captured by the inspection system or the inspection device connected downstream, wherein this test print is preferably known to this inspection device. Furthermore, this test print can be correspondingly identified and verified, in particular by a comparison. Only when the test feature, which in particular is previously known, is present is the machine regarded as ready for operation and capable of production or further production.

In this case it would be possible in principle for the printing system to receive the request to carry out a test run and to inform the inspection system of what is to be found. On the other hand, however, it would also be possible for the inspection system to receive the request for testing and accordingly to transmit to the printing system or the printing unit the request to apply a specific print to the objects. In addition it would also be conceivable for corresponding prints or features to be distributed over the machine main computer or a WMS (warehouse management system).

In a further preferred method, in addition to the test print it is also possible to print data which identify the container in particular for later logging. In this case for example data could be printed, such as a date, a time, a designation of the container, a manufacturer, data which characterise the printing unit and the like.

In a further preferred method the inspection device has a colour camera or generally an image recording device, which is suitable for recording spatially resolved images.

In a further preferred method it is possible for the container thus printed, which is also designated below as a test container, to be removed from a stream of containers. In this case it would be possible that in the context of the test operation all the containers are only provided with test markings and are accordingly removed. However, it would also be possible that during the production a test operation is quickly activated and only the container or the containers removed in the context of this test operation are printed. In this case for example such a container can subsequently be recognised by an inspection device and removed, but it would also be conceivable that this container is additionally provided with a marking which identifies it as a test container. In addition it would also be conceivable that already during printing of the container with the test marking this container is classified as a test container. Since, as mentioned above, the containers are preferably transported separately, it is also easily possible to remove these containers individually.

In particular, as mentioned above, the objects are containers and are particularly preferably plastic containers and particularly preferably plastic bottles. However, it would also be conceivable to apply the invention in the case of other containers, for example glass containers and metal containers (for example made of tinplate or aluminium).

In a further preferred method the objects are examined, in particular inspected, during a shutdown. This means that the containers are first of all printed and subsequently are preferably stopped in the region of the inspection device and thus can be examined. The test containers are preferably transported cyclically in the context of a test operation. In this case it would be possible for the printing of the containers with the test marking to take place at a predetermined operating speed and in particular at a normal production speed and for the subsequent inspection to take place at a modified speed, preferably a lower speed, and in particular while the containers are at a standstill with respect to the transport path (but the containers can nevertheless be rotated about their longitudinal direction).

Advantageously the print applied is a multi-colour print.

In a further preferred method the inspected container is associated with the printing unit which printed the inspected container. In this variant it would be possible to provide a plurality of printing units which alternately or successively apply the prints to the containers. In this procedure the specific test print or the test marking is associated with the printing unit which applied this test print. Preferably at least two printing units apply prints to at least partially identical regions of the container. In this case these printing units can for example apply different colour components. However, it would also be possible that the printing units to apply complementary prints for instance along a longitudinal direction of the container, wherein preferably an overlap region of the container is provided which is printed by both printing units.

The printing units may be printing units in the narrower sense. Within the context of the invention, however, printing units are also understood to be units such as foil coating modules which serve to produce metallic effects. In this case for example a cold foil stamping (or an inline foil coating) could be carried out. Such units could at least partially replace the printing units described above. In addition it would also be conceivable that the printing unit prints on the glue. The test methods described here can also be used in this case.

In a further preferred method the inspection device records at least one image of the container to be inspected. Advantageously instructions are issued to a user in accordance with the result of the inspection. Furthermore it is possible for the inspection device to record a plurality of images of a print. In addition it is also possible for the inspection device to sense or scan the test marking (in particular optically and contactlessly) and for example during this scanning the container is moved, for example rotated, with respect to the inspection device and/or the inspection device is moved in a longitudinal direction of the container during this scanning.

In a further method it is also possible for the objects to be printed by a plurality of printing units. In this case it would be possible for an inspection device to be associated with each printing unit. However, it is more economical to provide a central inspection device downstream of all the printing units.

In a further advantageous method the objects, in particular containers, are transported separately. Thus the containers preferably have a predetermined spacing from one another. Advantageously the containers are guided along a transport path which is circular at least in sections. Thus for example containers can be delivered to a printing unit and can be transported with these individual printing units and passed on again in a printed state to a take-off device.

Advantageously it can be defined or specified when an inspection result deviates from a desired result. This desired result may be for example an ideal or desired print on a container.

The at least one printing unit is preferably arranged stationary (relative to the transport path of the containers) and the containers are guided past this printing unit. However, it would also be conceivable for the printing unit to be moved with the container.

In a further preferred method the printing of the object with the test marking takes place in the context of a test mode of the apparatus. This test mode can in particular precede a working operation or a production operation. As mentioned above, it would be possible in this case to carry out this test operation after a change of type or with a resumption of a working operation. In addition it may also be possible for this test mode to be run through during production, for example at predetermined times.

In a further preferred method, in the working operation of the apparatus a marking, in particular a print, is checked, in particular the marking or the print which is to be applied to the containers. Preferably for this checking a different inspection device is used from the inspection device which is used for the test mode. In this case it is pointed out that preferably the inspection device which is used in the working operation can meet different criteria than the inspection device which is used in the test operation. Preferably the inspection device which inspects the containers in the working operation has a camera and in particular a colour camera.

In a further preferred method a further object is printed with a test marking. Thus it is possible that first of all a first container is printed with a test marking, then this is inspected and particularly preferably at least one printing parameter is adapted or changed in response to this inspection. Subsequently the said further object is printed using the modified printing parameters. Thus for example in the context of the first inspection it can be ascertained that two printing units are not aligned completely correctly with one another.

The inspection device can for instance give to the control device of the printing unit the instruction to offset a position of a printing element. Subsequently a further test container can in turn be printed and preferably subsequently can in turn be inspected. If it is now ascertained that the print is satisfactory, the production of the containers can be started. Thus a further object is preferably printed using a result of the first inspection. Thus an adjustment and/or calibration of the at least one printing unit preferably takes place for the test operation.

Furthermore it would also be possible to print a plurality of containers, in particular by means of a control loop. Preferably at least two containers, preferably at least three containers, preferably at least four containers and preferably at least five containers are printed with the test marking. However, in addition or as an alternative to the control loop it is also possible that in response to an inspection which has been carried out a notice is issued that an intervention can be made for instance by a user. Thus the inspection device advantageously recognises whether a fault can be remedied automatically, for instance a position adjustment can be carried out, or whether the fault cannot be remedied automatically, for instance if a printing element is defective.

In a further advantageous method the test marking is compared with at least one reference value and in particular a reference marking. In this case it is possible for this reference marking to be stored in the system or in a store. On the basis of this comparison a value can be output which is necessary for example for a calibration of the (stored) printing parameters or the printing unit.

In a further advantageous method the containers are printed by at least two printing units. This preferably involves at least two controlled units which also use the respective specific printing parameters. In this case it is possible for these printing units to print the containers substantially simultaneously, but it would also be possible for the printing units to print the containers one after the other. As mentioned, overlapping print areas can be printed.

In a further preferred method the printing units apply a multi-colour print to the container.

In a further preferred method a plurality of inspection results can be associated with the respective responsible printing units. In this way statistics can be generated from a plurality of recordings (for example by histograms or long-term averages). In this way, taking account of the responsible equipment unit a trend can be displayed which indicates a deterioration for instance of a printed image. Warning limits and intervention limits can also be implemented, i.e. limits above which a container can no longer be regarded as acceptable can be defined for the inspection result.

In a further preferred method the inspection device performs an evaluation of at least one colour property of the marking. In particular colour test prints are used and inspected. A colour management system (CMS) is preferably used for the evaluation, in order that the colour spaces to be monitored of an image recording device, such as for instance a camera (this is an additive colour space) and the CMYK printing system (subtractive colour space) are brought into conformity.

In this connection methods can be employed which use matrix profiles and/or LUT profiles. LUT profiles are preferably used. In a colour management system a LUT (Look Up Table) can use completely different types of colour profiles, such as in this case the colour space of the camera and that of the CMYK printing system. The above-mentioned matrix profiles are simpler and smaller and are often used for monitors. In a matrix ICC profile the input RGB values are transformed into profile connection space values by means of a mathematical operation (of a 3×3 matrix). In the case of a LUT profile, tables are necessary which contain entries for each combination of an input RGB value and a corresponding CIELAB value. Such procedures are used in particular, as here, for printers.

In a further procedure, first of all a test print is applied to the containers, such as the above-mentioned test image, and particularly preferably also a marking, which indicates that the containers thus printed is a test container. Thus these test containers are also suitable as documentation, in order to demonstrate that the printing machine or the printing unit operates satisfactorily. Advantageously at least one type of error is identified by the inspection device.

The inspection device is preferably suitable and intended in order at least to detect an error in the test marking and/or the printing unit. The inspection device preferably also performs an evaluation of at least one colour property of the marking, wherein in particular colour test prints are used and read out.

Advantageously this is a type of error which is selected from a group of error types which includes the register accuracy (front or rear face of non-round containers), a register difference or a colour register, smearing of the marking, and the like. In addition errors can also be detected, such as a missing DOT series (for example as a result of nozzle failures), an incorrect position of the printed image (in the XY direction with respect to the container and/or a rotated position), or an incorrect positioning or a crooked container.

In this connection it is pointed out that with the inspection devices used in operation, such as in particular colour cameras, substantially only geometric features can be examined precisely which relate on the one hand to the triggering or path control of the printing system or also mechanical inadequacies or nozzle failures.

In a further preferred method the inspection device inspects the test marking by means of an inspection element, which is selected from a group of inspection elements which includes spectrophotometers, densitometers, in particular colour densitometers and spectral densitometers. Preferably the above-mentioned inspection device is only activated at the start of a test operation. In this case it would be possible for the inspection device which inspects the containers in the context of the working or production operation to be correspondingly deactivated.

Since with respect to the quality control of the colours or the colour density measurement a colour camera is only suitable for quality control to a limited extent, it is proposed here that in the event of a test they are changed selectively by means of quality control. This means that in a normal working operation a colour camera can be used for the said test mode, but with an inspection device of the type described above. In this case, for example, during the production (for example hourly) a test pattern of the type described above can be applied to one or more containers and preferably can be checked by means of CMOS or CCD camera and discharged. However, it is also possible to change over to a system for colour space control.

In a further preferred method the pressure, in particular for the test operation, is switched over automatically to a suitable media wedge. In this case, for example, Ugra offset test wedges, Postscript control wedges or Ugra/Fogra media wedges CMYKV30 can be used.

Colour and position adjustments can be carried out quickly and precisely with defined criteria by an automated optimisation loop. In this way human influence can be avoided. In addition, considerable set-up time can preferably be saved by means of automated routines, since measurements take place inline with direct feedback, so long as specific tolerance values are not exceeded.

Likewise it is conceivable for a second or third colour print head (redundant) to be available as backup in the event of a malfunction and, according to the subject of the invention, can be adjusted, calibrated and thus synchronised.

In this case it is also conceivable that such an optimisation loop, in particular with sufficient computing power, also takes place during ongoing production, without having to initiate a special procedure for this purpose. In this way a continuous quality control would be possible. In this case containers can be regularly printed with a test pattern, inspected and subsequently discharged from the production stream. As a result, with a constant quality the machine availability is significantly increased with respect to the process known from the prior art.

The containers are preferably illuminated during their inspection. In this case for illumination of the containers a standardised light (e.g. white light) can be used. In this case an inspection of the containers or of the test markings can be performed for example in a reflected light process or in a transmitted light process.

Advantageously the test marking is a test wedge and/or the test marking has a test wedge. This test wedge can have geometric signs or elements which are particularly suitable for an evaluation by an inspection device.

Furthermore, the present invention is directed to an apparatus for the printing of objects and in particular of containers. This apparatus has a transport device which transports the objects along a predetermined transport path and at least one first printing unit which is suitable and intended for applying a print to an outer wall of the object in the context of a working operation of the apparatus. Furthermore, the apparatus has a control device for controlling a first printing unit.

Furthermore, according to the invention the first printing unit is suitable and intended for applying at least one test marking to an outer surface of the object in the context of a test operation, and furthermore the apparatus has a first inspection device for inspecting the objects printed with the test marking, wherein this inspection device is arranged downstream of the first printing unit in the transport direction of the objects and outputs at least one inspection result which can be used by the control device for controlling the first printing unit.

Therefore with regard to the apparatus it is proposed that a possibility be created for applying a marking and in particular a special test marking to the containers in a special test operation and in particular for achieving a calibration of the apparatus in particular on the basis of this marking. Advantageously, therefore, the apparatus has a control device which regulates the at least first printing unit on the basis of the inspection result.

In a further advantageous embodiment the apparatus has at least one second inspection device which is suitable and intended for inspecting prints applied to the objects during a working operation. This inspection device may be an inspection device which in particular also monitors the quality of the print even in the ongoing operation. In this case, however, it is possible that in dependence upon a result of this second inspection device other countermeasures are taken, for instance a shutdown of a specific printing unit or also a discharge of a container printed by this printing unit. Furthermore, it would also be possible and preferable that the same inspection device is used both for the calibration operations described here and also in operation. In this case the inspection device which is used in working operation can also be used for the examination of the test markings. In this case, however, the inspection device can be switched to other parameters for the examination of the test marking.

In a further advantageous embodiment the device has an illumination device which illuminates the containers in particular during inspection thereof by the first inspection device. In this way a uniform illumination of the containers can be achieved.

Advantageously the described first inspection device, which is used in particular in the test mode, is not used in the context of the usual working operation. Thus it is possible in the normal working operation that this first inspection device is moved out of a position in which it can perform inspections and into a rest position.

Because the sensing distances of the required measuring means are very short and mechanical collisions can occur in the production operation, it is proposed that after the test, for example, of colour fidelity and the calibration the first inspection device is moved or driven into a protection region. This can take place by means of an electrical drive or also manually. Thus for example telescopic rails and end stops may be provided. In addition, this protection region should also be protected, for example by overpressure in the protective housing, against spray mist caused by the printing operation.

Therefore in a further embodiment the first inspection device is movable between a working position (which in particular is a position taken up in the context of a test operation) on the one hand and a rest position (which in particular is also taken up in the context of the working operation) on the other hand.

Further advantages and embodiments are apparent from the appended drawings.

Figure 2:
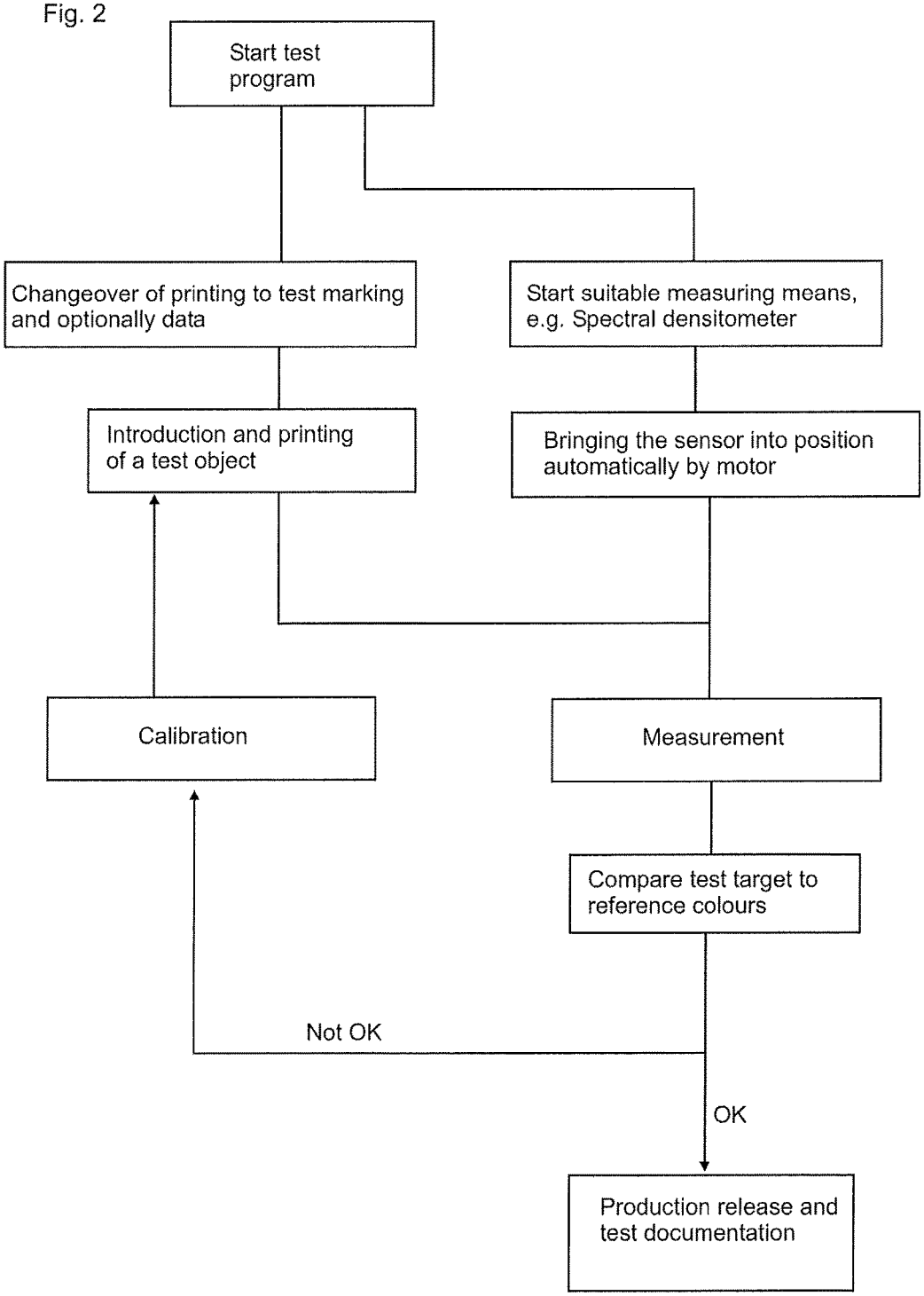

In the drawings:

FIG. 1 shows a schematic representation of an apparatus according to the invention; and FIG. 2 shows a flow diagram for a method according to the invention.

FIG. 1 shows a schematic representation of an apparatus 1 according to the invention for printing containers 10. In this case the containers 10 are delivered by means of a delivery device 52 and are discharged by means of a discharge unit 54. Furthermore, the apparatus 1 has a carrier 24 which is rotatable with respect to an axis of rotation D and is a component of a transport device 2. Holding devices 22 which serve for holding the containers 10 to be equipped (of which only one is shown) are arranged on this carrier. Furthermore, printing units 4, 6, 7 are arranged on the carrier 24, but only three of these equipment units are shown. The reference numerals 14, 16 and 17 relate in each case to control devices for controlling the printing units 4, 6 and 7.

The embodiment shown in FIG. 1 involves printing units which apply a direct print to the containers 10. In this case these printing units 4, 6, 7 can have a plurality of print heads, for example three print heads, which are arranged one above the other. Furthermore, the apparatus has rotation devices which enable each individual container 10 to be rotated with respect to its longitudinal direction (which here extends perpendicularly to the drawing plane).

The reference P identifies the transport path, in this case circular, of the containers 10 to be equipped.

An inspection device 8 which checks the containers is arranged downstream with respect to the holding elements and the equipment units. In this case this inspection device inspects these containers or the test markings thereon, in particular in the context of a test operation of the device. For this purpose the inspection device can have a storage device 32 in which reference images are stored, in particular reference images of test prints. Furthermore, the apparatus has a comparison device 34 which compares the recorded images of the test markings with the reference images. On the basis of this comparison printing parameter of the control device can be changed, in particular in order to achieve an improvement in the printing.

FIG. 2 shows a flow diagram for a method according to the invention. In this case first of all a test program or test method is started. As mentioned above, this start can be triggered by the user, i.e. for example manually, but it would also be possible for the start to take place automatically according to defined specifications, for instance after a product changeover. The reference numeral 18 designates a storage device into which the inspection device can be introduced, in particular during a production operation of the apparatus 1.

This storage device preferably has a housing which protects the inspection device at least against contaminations such as for instance colour splashes. In this case the apparatus can have a carrier (not shown), relative to which the inspection device 8 can be moved in order thus to be moved from a rest position (represented by a broken line in FIG. 1) into a working position (during a test operation). The reference numeral 12 designates a further inspection device which inspects the containers (in particular during a production operation). Moreover, the apparatus preferably has an assigning device (not shown), by which the printing unit which has produced the inspected print is assigned to the inspection result of the further inspection device. However, it would also be possible for this inspection device to be arranged directly on a movable carrier, for instance the discharge device 54.

Two branches are shown in FIG. 2, wherein the right branch illustrates actions by the inspection device and the left branch illustrates actions by the printing unit. First of all, with regard to of the at least one printing unit there is a changeover to the printing with the test marking.

Additionally it is possible that, as well as the test marking, metadata are also printed, as mentioned above, for instance a date or a time. In addition, at the beginning of the measuring program an inspection device is also activated, which also serves especially for detecting the test marking.

In this case it is possible for this inspection device to be moved for example out of a housing into a working or measurement position. In this case, particularly preferably, a measurement sensor can be brought automatically into a suitable measurement position. Subsequently a test object, such as in particular a container, can be moved in and can be printed with the test marking. This container thus printed is subsequently inspected by the inspection device and in this case at least one measurement is carried out. Within the context of this inspection it is possible that one or more recordings of the test markings are carried out.

In a further method step the recorded image or the measurements carried out are compared with reference images and in particular also reference colours.

If this comparison results in a sufficient conformity between the measured values and the reference values, this is a sign that the printing is satisfactory and the production can be started. In this case it is also possible to determine limiting values within which a test print carried out is still regarded as satisfactory. Outside these limits the container thus obtained and/or the printing can be regarded as defective.

In addition, documentation of the test can be carried out and for this purpose in particular the container provided with the test marking can also be discharged. If the result of the inspection is that the test marking is unsatisfactory, a calibration takes place, in particular a calibration of the control device and/or of the printing unit. In this case a container is moved in and printed with the test marking. Subsequently, here too, a measurement or an inspection of the test marking takes place and it is checked whether this meets the predetermined criteria. If required, these steps can be carried out a number of times. In this case in particular the method described here can proceed automatically and thus, in particular at the start of production, can carry out a controlled calibration of the printing unit.

Sometimes the available measuring means cannot completely detect the test marking. Therefore the transport of the printed containers is preferably halted in the region of the inspection device or the container transport is stopped. In this position scanning of the container can then be carried out in a vertical direction. If for example a second scan is necessary, the machine can be moved further by the necessary amount and, if required, the rotated position of the container with respect to the measuring means can be corrected again and a further image or a further scan can be produced.

After the measurement or the calibration is carried out, the inspection device can be moved back into a protection region, as mentioned above.

The applicant reserves the right to claim all the features disclosed in the application documents as essential to the invention in so far as they are, individually or in combination, novel over the prior art. Furthermore it is pointed out that features which may be advantageous per se have also been described in the individual drawings. The person skilled in the art recognises immediately that a specific feature described in a drawing may also be advantageous without the incorporation of further features from this drawing. Furthermore the person skilled in the art recognises that advantages may also result from a combination of several features shown in individual drawings or in different drawings.

LIST OF REFERENCE SIGNS

1 apparatus
2 transport device
4, 6, 7 equipment units
8 inspection device
10 container
14, 16, 17 control device for printing units
12 further inspection device
18 storage device
22 holding device
24 carrier
32 storage device
34 comparison device
52 delivery device
54 discharge device
T transport path
D axis of rotation

The invention claimed is:

1. A method for printing objects, in particular containers, including applying prints to the containers, wherein the containers are transported along a specified transport path, and the outer surface of the containers is printed at least temporarily by at least one printing unit, wherein a controller controls the printing of the containers by the at least one printing unit on the basis of at least one printing parameter, wherein at least one object to be printed is printed with at least one test marking in order to ascertain the printing parameter, and the object provided with the test marking is then inspected by at least one inspection device, wherein the printing parameter is derived from the result of the inspection, wherein the prints are checked by a test program, which automatically requests a user to check the at least one printing unit, and wherein the test is run before production and/or specific test cycles are used.

2. Method according to claim 1, wherein the printing of the object with the test marking takes place in the context of a test mode.

3. Method according to claim 1, wherein a further object is printed with the test marking.

4. Method according to claim 1, wherein the test marking is compared with at least one reference value.

5. Method according to claim 1, wherein the container is printed by at least two printing units.

6. Method according to claim 1, wherein the inspection device performs an evaluation of at least one colour property of the marking.

7. Method according to claim 1, wherein the inspection device is suitable and intended for detecting at least one defect of the test marking.

8. Method according to claim 1, wherein the inspection device inspects the test marking by means of an inspection element which is selected from a group of inspection elements which includes spectrophotometers, densitometers, in particular colour densitometers and spectral densitometers.

9. Apparatus for printing objects and in particular containers, with a transport device which transports the objects along a predetermined transport path, with at least one printing unit, which is suitable and intended for applying a print to an outer wall of the object in the context of a working operation, and with a control device for controlling a first printing unit of the at least one printing unit, characterised in that the first printing unit is suitable and intended for applying at least one test marking to an outer surface of the object in the context of a test operation, and with a first inspection device for inspecting the objects printed with the test marking, wherein the first inspection device is arranged downstream of the first printing unit in the transport direction of the objects and outputs at least one inspection result which can be used by the control device for controlling the first printing unit, wherein the prints are checked by a test program, which automatically requests a user to check the at least one printing unit, and wherein the test is run before production and/or specific test cycles are used.

10. Apparatus according to claim 9, wherein the apparatus has at least one second inspection device which is suitable and intended for inspecting prints applied to the objects during a working operation.

11. Apparatus according to claim 9, wherein the apparatus comprises an inspection device which is used in the working operation that can meet different criteria than an inspection device used in the test operation.

12. Apparatus according to claim 9, wherein the apparatus has an illumination device which illuminates the containers during an inspection thereof by the first inspection device.

13. Apparatus according to claim 9, wherein the first inspection device is movable between a working position and a rest position.

14. Apparatus according to claim 9, wherein after the test is run the at least one first inspection device is moved or driven into a protection region.

15. Apparatus according to claim 14, wherein the protection region protects by the first inspection device by overpressure against a spray mist caused by a printing operation.

16. Method according to claim 1, wherein the test marking is a test wedge and/or the test marking has a test wedge.

17. Method according to claim 1, wherein the inspection device has a color camera or a related image recording device that is suitable for recording spatially resolved images.

18. Method according to claim 1, wherein in a normal working operation a color camera is used and for the test mode an inspection device is used.

19. Method according to claim 1, wherein color and position adjustments are carried out quickly and precisely with a defined criteria by an automated optimization loop.

20. Method according to claim 1, wherein an optimization loop takes place during an ongoing production without having to initiate a special procedure.

21. A method for printing objects and in particular containers, wherein the containers are transported along a predetermined transport path, and an outer surface of the containers is printed at least temporarily by at least one printing unit, wherein a controller controls the printing of the containers by the at least one printing unit on the basis of at least one printing parameter, wherein at least one object to be printed is printed with at least one test marking in order to ascertain the at least one printing parameter, and the at least one object with the test marking is subsequently inspected by at least one inspection device, wherein the at least one printing parameter is derived from a result of the inspection, wherein the printing of the object with the test marking takes place in the context of a test mode, wherein in the working operation the marking or the print which is to be applied to the containers is checked, wherein for this checking a different inspection device is used from the inspection device used for the test mode, wherein the inspection device used in the working operation meets different criteria than the inspection device used in the test operation.

* * * * *